United States Patent [19]

Goto et al.

[11] 4,014,960

[45] Mar. 29, 1977

[54] CARBURATOR FOR A STRATIFIED COMBUSTION ENGINE WITH A PRECHAMBER

[75] Inventors: Kenji Goto; Takao Niwa, both of Shizuoka, Japan

[73] Assignee: Toyota Jidosha Kogyo Kabushiki Kaisha, Toyota, Japan

[22] Filed: Feb. 26, 1975

[21] Appl. No.: 553,408

[30] Foreign Application Priority Data

Sept. 7, 1974 Japan ..... 49-103340

[52] U.S. Cl. ..... 261/23 A; 123/127; 123/32 ST

[51] Int. Cl.[2] ..... F02M 11/02

[58] Field of Search ..... 261/23 A; 123/127, 32 ST

[56] References Cited

UNITED STATES PATENTS

| | | | |
|---|---|---|---|
| 2,121,920 | 6/1938 | Mallory | 261/23 A |
| 2,766,024 | 10/1956 | Smitley et al. | 261/23 A |
| 2,823,020 | 2/1958 | Smith | 261/23 A |
| 2,868,520 | 1/1959 | Olson et al. | 261/23 A |
| 3,071,124 | 1/1963 | Cramer | 261/23 A |
| 3,249,099 | 5/1966 | Saxby | 123/127 |
| 3,817,223 | 6/1974 | Doss | 123/32 ST |
| 3,852,379 | 12/1974 | Shishido et al. | 123/32 ST |
| 3,882,831 | 5/1975 | Date et al. | 123/32 ST |

*Primary Examiner*—Tim R. Miles
*Attorney, Agent, or Firm*—Pollock, Vande Sande & Priddy

[57] ABSTRACT

A carburetor for a stratified combustion engine with a precombustion chamber comprises a first body having first and second bores for supplying lean mixture into a main combustion chamber of the engine, a second body having a third bore for supplying rich mixture into the precombustion chamber, and an actuator for swinging a throttle valve provided in said third bore in accordance with a function proportional to a negative pressure within said first bore. The carburetor is adapted to allow any desired arrangement of said first body and said second body in spaced relation with each other so as to facilitate the arrangement of various equipments in an engine room as well as the design of the engine.

1 Claim, 2 Drawing Figures

CARBURATOR FOR A STRATIFIED COMBUSTION ENGINE WITH A PRECHAMBER

BACKGROUND OF THE INVENTION

The present invention relates to a carburetor for a stratified combustion engine with a precombustion chamber.

As an effective method for simultaneously reducing CO, HC and NOx included in exhaust gas from a gasoline engine, it has been theoretically known to supply extremely lean mixture to an engine. However, it has been also known that such lean mixture could not be burnt stably in a conventional gasoline engine because of its poor ignitability and extreme slow combustion rate.

As an internal combustion engine capable of being operated using lean mixture, a stratified combustion engine with a precombustion chamber has been known in the past. A combustion chamber of such as engine consisted of a main combustion chamber and a precombustion chamber communicating with the main combustion chamber through a connecting bore. The combustion in the stratified combustion engine with a precombustion chamber is carried out in the following manner, as has been well known in the art.

After rich mixture has been supplied into the precombustion chamber through a sub-intake valve provided in the precombustion chamber while lean mixture has been supplied into a main combustion chamber through a main intake valve provided in the main combustion chamber, rich mixture in the precombustion chamber is first ignited. Then the flame jets are injected from the precombustion chamber through the connecting bore to the main combustion chamber so that the lean mixture, which would be hardly ignited by conventional combustion system, can be completely burnt by the flame jet without misfire.

Although the stratified combustion engine of the above type has been developed to be put into practice, one of the problems to be solved in the above type of engine resides in the fact that a carburetor of a known type cannot be used with the above type of engine. Thus, although carburetors for exclusive use with the above type of engine have been developed, there are also many problems to be solved in them.

One of the problems involves the structure of the throttle valve actuator mechanism in the carburetor. Particularly, such a carburetor includes a first body having a first bore and a second bore similar to those of a known two-barrel type carburetor as well as a second body having a third body for supplying rich mixture to the precombustion chamber, the bores being provided with a first, a second and a third throttle valves therein, respectively. In the above known carburetor for use with the stratified combustion engine having the precombustion chamber, the first and third throttle valves are mechanically coupled by a link so that when the first throttle valve is swung by an accelerator pedal, the third throttle valve is also swung in accordance with the movement of the first throttle valve. Thus, in the throttle valve actuator mechanism wherein the first throttle valve and the third throttle valve are mechanically coupled by the link, the first bore and the third bore must be positioned in adjacent relationship, which results in an increase of the overall width of the carburetor and brings about an undesirable problem in the design of the engine. In addition, when such a throttle valve actuator mechanism is used, since the third throttle valve is not moved proportionally to the magnitude of a negative pressure within an intake manifold, gaseous mixture of a proper density may occasionally not be supplied to the precombustion chamber through the third bore.

SUMMARY OF THE INVENTION

It is, therefore, an object of the present invention to provide a carburetor of novel construction which has overcome the problems encountered in the known carburetor for a stratified combustion engine with a precombustion chamber.

The carburetor of the present invention is characterized in that the third throttle valve is connected with a diaphragm actuator which is operated in response to a negative pressure within the first bore, and that a first body having the first and second bores and a second body having the third bore are separated from each other. As a result, the first body and the second body can be arranged at any desired positions in the engine room in spaced relation to each other.

BRIEF DESCRIPTION OF THE DRAWINGS

In the accompanying drawings.

DETAILED DESCRIPTION OF THE INVENTION

The preferred embodiments of the present invention will now be described with reference to the accompanying drawings.

Figure 1:
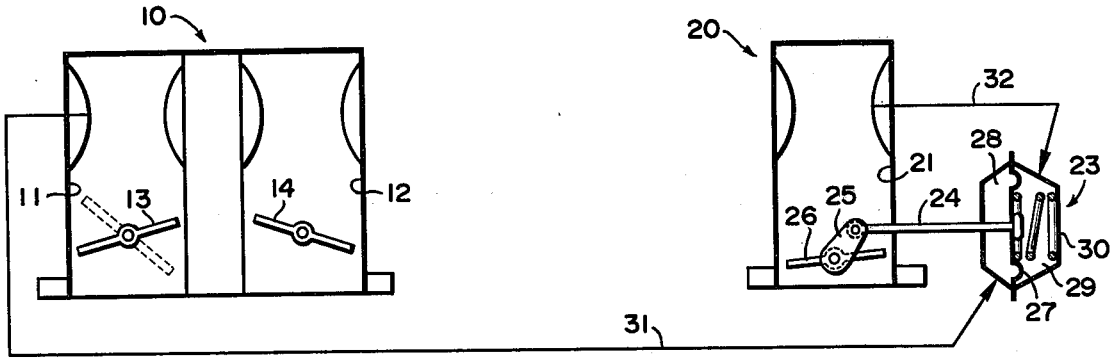
FIG. 1 is a schematic view of a first embodiment in accordance with the present invention.

Referring to FIG. 1 which shows a schematic view of a first embodiment in accordance with the present invention, the numeral 10 designates a first body having a first bore 11 and a second bore 12, and the numeral 20 designates a second body having a third bore 21. The first bore 11 of the first body 10 is provided to supply gaseous mixture into a main combustion chamber of the engine when starting the engine or during light load engine operation, and includes a throttle valve 13 therein. The second bore 12 functions to supply gaseous mixture into the main combustion chamber of the engine during heavy load engine operation and includes a throttle valve 14 therein.

The second body 20 having the third bore 21 is connected to the precombustion chamber of the engine to supply rich mixture into the precombustion chamber. Provided in the third bore 21 is a throttle valve 26 which is connected to a diaphragm type actuator 23 through a rod 24 and a link 25.

The actuator 23 is provided with a closed housing 30 having a diaphragm 27 operative to swing the throttle valve 26 in the third bore 21 in accordance with a function which is proportional to the difference between a negative pressure within the first bore 11 and a negative pressure within the third bore 21. In the housing 30, two chambers 28 and 29 are defined by the diaphragm 27 on either sides thereof. A conduit 31 communicating the chamber 28 with the first bore 11 introduces a negative pressure in the first bore 11 into the chamber 28 which tends to deflect the diaphragm 27 in the left-hand direction as viewed in FIG. 1. Another conduit 32 communicates the chamber 29 of actuator 23 with the third bore 21 to introduce a negative pressure in the third bore 21 into the chamber 29 which tends to deflect the diaphragm 27 in the right-hand direction as viewed in FIG. 1.

In the prior art carburetor for the stratified combustion engine with the precombustion chamber, the first body having the first and second bores for supplying lean mixture to the main combustion chamber and the second body having the third bore for supplying rich mixture to the precombustion chamber were integrally structured. This caused an increase in the overall width of the carburetor and hence required troublesome consideration in the design of the engine and the arrangement of the accessory equipments in the engine room. According to the present invention, since the section for supplying lean mixture to the main combustion chamber and the section for supplying rich mixture to the precombustion chamber are separated, both can be separately arranged in the engine room, and the design of the engine as well as the arrangement of the accessory equipments in the engine room are facilitated.

Figure 2:
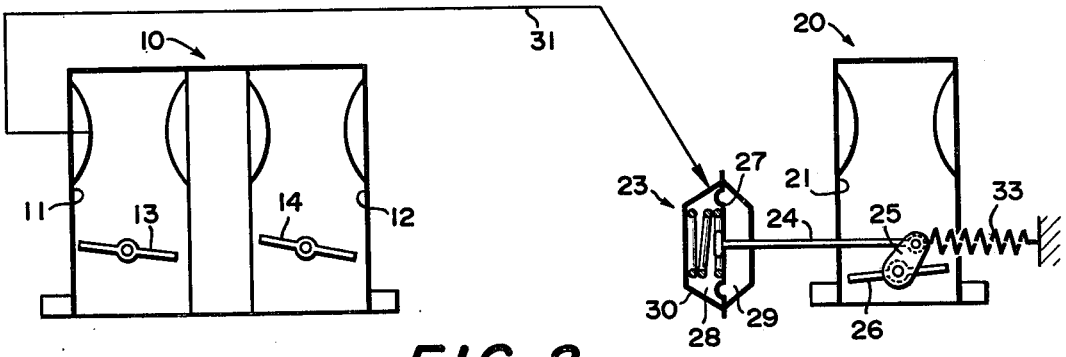
FIG. 2 is a schematic view of a second embodiment in accordance with the present invention.

In a modified embodiment shown in FIG. 2, a tension spring 33 extending between the link 25 or rod 24 and an appropriate fixed portion of the engine is used instead of the conduit 32 of FIG. 1. Accordingly, the throttle valve 26 in the third bore 21 is moved by the difference between the spring force of the spring 33 and the negative pressure within the first bore 11.

Such an arrangement can be employed instead of the first embodiment shown in FIG. 1 because there exists a linear proportional relationship between the magnitude of the negative pressure within the first bore 11 and the magnitude of the negative pressure within the third bore in a certain range of the engine acceleration, and the throttle valve 26 in the third bore 21 may be operated within such a linear proportional range of the negative pressures within the bores.

The operations of the respective sections in the embodiments shown in FIGS. 1 and 2 will now be described.

In the embodiment shown in FIG. 1, when a car having the carburetor mounted thereon is started and accelerated so that the throttle valve 13 in the first bore 11 assumes the position shown by a broken line in FIG. 1, the negative pressure within the conduit 31 increases so that a negative pressure is introduced into the chamber 28 of the actuator 23. As a result, the diaphragm 27 is displaced to the left as viewed in FIG. 1 and the throttle valve 26 in the third bore 21 is swung counterclockwise as viewed in FIG. 1 through the rod 24 and the link 25. Therefore, relatively lean gaseous mixture is supplied to the main combustion chamber of the engine through the first bore 11 of the first body 10 of the carburetor and at the same time rich gaseous mixture is supplied to the precombustion chamber of the engine through the third bore 21 of the second body 20 of the carburetor. It should be understood from FIG. 1 that in this case the degree of opening of the throttle valve 26 in the third bore 21 is determined by the difference between the negative pressure within the first bore 11 and the negative pressure within the third bore 21.

When the car completes the acceleration in the start period and reaches a high speed operation, the degree of opening of the throttle valve 13 within the first bore 11 and the degree of opening of the throttle valve 26 in the third bore 21 have both reached their maximum degree of opening, and the degree of opening of both valves will no longer be varied in the high speed operation range. Thus, it follows that in the high speed operation range gaseous mixture of a constant density will always be supplied into the precombustion chamber through the third bore 21. As is well known, when the throttle valve 14 in the second bore 12 is swung in the high speed operation range, the density of the gaseous mixture supplied into the main combustion chamber is no longer proportional to the density of the gaseous mixture supplied into the precombustion chamber.

In the embodiment shown in FIG. 1 the amount of swinging of the throttle valve 26 in the third bore 21 is proportional to the difference between the negative pressure within the first bore 11 and the negative pressure within the third bore 21, but in the embodiment shown in FIG. 2. the amount of the swinging of the thottle valve 26 in the third bore 21 depends on the difference between the negative pressure within the first bore 11 and a force proportional to the amount of expansion or compression of the spring 33 and it is independent of the magnitude of the negative pressure within the third bore 21. In other words, in this second embodiment the throttle valve 26 in the third bore 21 is not feedback-controlled but it is controlled merely in dependence on the magnitude of the negative pressure within the first bore 11.

In the embodiments described above, the carburetor according to the present invention comprises two bodies which can be disposed in spaced relation from each other, and it is characterized in that the throttle valve in the third bore which supplies the gaseous mixture into the precombustion chamber is swung depending upon the difference between the negative pressure within the first bore and the negative pressure within the third bore.

It should be understood that the accompanying drawings and associated description are merely illustrative of the present invention and various changes as well as modifications of the present invention may be made within the scope of the claims.

What is claimed is:

1. A carburetor assembly for use with a stratified combustion engine having a main combustion chamber and a precombustion chamber, said assembly comprising a first body having first and second bores to supply lean gaseous mixture into the main combustion chamber, a second body having a third bore to supply rich gaseous mixture into the precombustion chamber, said second body being separate from said first body and being adapted to be disposed at any desired location spaced from said first body, a throttle valve in said third bore, and an actuator for pivoting said throttle valve, said actuator comprising a closed housing having a diaphragm disposed therein, said diaphragm dividing the interior of said closed housing into two chambers, a first conduit connected to said actuator for introducing a negative pressure in said first bore into one of said chambers so as to deflect said diaphragm in one direction, a second conduit connected to said actuator for introducing a negative pressure in said third bore into the other of the two chambers so as to deflect said diaphragm in the opposite direction, and means connecting said diaphragm to said throttle valve whereby variations in the position of said diaphragm vary the position of said throttle valve in said third bore.

* * * * *